United States Patent [19]

Yamanouchi

[11] 3,947,334

[45] Mar. 30, 1976

[54] APPARATUS FOR PURIFYING SODIUM

[75] Inventor: Atsuo Yamanouchi, Hitachi, Japan

[73] Assignee: Hitachi, Ltd., Japan

[22] Filed: Oct. 27, 1971

[21] Appl. No.: 192,937

[30] Foreign Application Priority Data

Nov. 11, 1970 Japan ..... 45-98729

[52] U.S. Cl. ..... 204/140; 204/129

[51] Int. Cl.[2] ..... C25F 1/00

[58] Field of Search ..... 204/140, 195 S, 129

[56] References Cited

UNITED STATES PATENTS

| | | | |
|---|---|---|---|
| 3,309,233 | 3/1967 | McPheeters et al. | 204/195 S |
| 3,378,478 | 4/1968 | Kolodney et al. | 204/195 S |
| 3,400,054 | 9/1968 | Ruka et al. | 204/1 |
| 3,650,934 | 3/1972 | Hickam et al. | 204/195 S |

*Primary Examiner*—T. M. Tufariello

*Attorney, Agent, or Firm*—Craig & Antonelli

[57] ABSTRACT

An apparatus for purifying sodium by electrically removing oxygen combined with liquid sodium from the liquid sodium, which comprises a liquid sodium to be purified and a reducing agent, the liquid sodium and the reducing agent being partitioned by a wall of solid electrolyte, a negative electric potential and a positive electric potential being applied to the liquid sodium side to be purified and the reducing agent side, respectively, whereby the combined oxygen is passed through the wall of solid electrolyte in a form of oxygen ion, $O^{--}$, and the liquid sodium is purified.

8 Claims, 3 Drawing Figures

INVENTOR

ATSUO YAMANOUCHI

BY Craig, Antonelli & Hill

ATTORNEYS

INVENTOR

ATSUO YAMANOUCHI

BY Craig, Antonelli & Hill
ATTORNEYS

APPARATUS FOR PURIFYING SODIUM

This invention relates to an apparatus for purifying liquid sodium by continuously removing oxygen from the liquid sodium.

Apparatuses using a liquid sodium such as sodium-cooled fast reactors or sodium circuits have been considerably developed in recent years, but the liquid sodium used in these apparatuses is very liable to undergo oxidation and is converted to sodium oxide, $Na_2O$, through a combination with oxygen. The resultant sodium oxide dissolves in the liquid sodium. When a liquid sodium containing the sodium oxide is used in a circuit, the sodium oxide will deposit at a low temperature section, adhere to the surrounding walls and clog the circuit passage. Furthermore, the oxygen in the sodium promotes corrosion and decarbonization of stainless steel constituting the circuit. These are problems encountered when the liquid sodium containing sodium oxide is used.

Therefore, it is necessary to add an apparatus for purifying the liquid sodium by removing sodium oxide impurities from the liquid sodium to an apparatus using the liquid sodium. Usually, an apparatus called "cold trap" is used for this purpose. An object of the cold trap is to remove the impurities by lowering the temperature of liquid sodium thereby to deposit and precipitate the impurities dissolved in excess of a saturated solubility. Another apparatus, which is called "hot trap," is also used. An object of the hot trap is to remove the oxygen from the liquid sodium by contacting the liquid sodium with a metal higher activity than sodium, for example, metallic zirconium, etc. at a high temperature thereby to take the oxygen away from the sodium oxide and form another metal oxide, for example, $ZrO_2$. However, according to any of these apparatuses, the oxygen in the liquid sodium cannot be completely removed, and a heat loss at heating or cooling of the trap is very large.

The present invention has been accomplished to eliminate these disadvantages of the prior art.

An object of the present invention is to provide an apparatus for electrically purifying sodium having a high efficiency in removing oxygen from the sodium.

Another object of the present invention is to provide a reducing agent for the apparatus for purifying the sodium suitable for a prolonged service.

Further object of the present invention is to provide an apparatus for purifying sodium capable of continuously carrying out the removal of oxygen.

Now, the present invention will be explained, referring to the accompanying drawings.

According to the present invention, a liquid sodium to be purified and a reducing agent are placed in a container through a partition wall of a solid electrolyte, and a negative electric potential and a positive electric potential are applied to the sodium side to be purified and the reducing agent side, respectively, whereby the oxygen in the liquid sodium to be purified is ionized and led to the reducing agent side through the partition wall. In this manner, the liquid sodium is purified.

Figure 1:
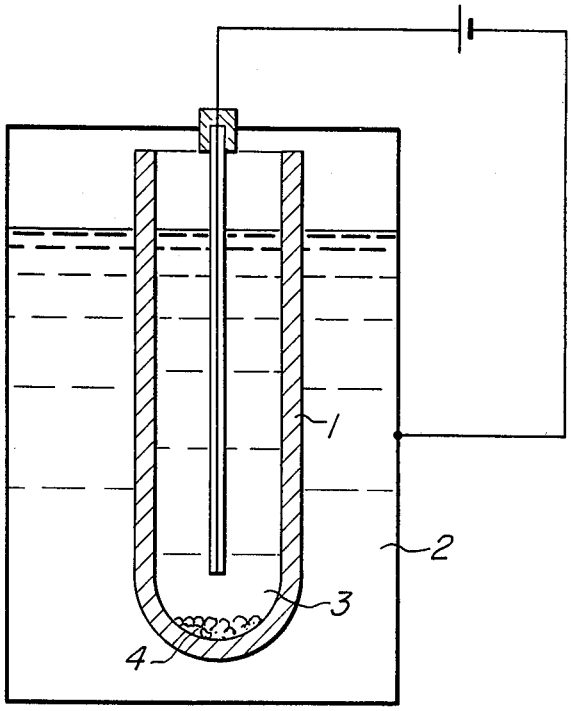
FIG. 1 is a schematic view of one embodiment of the present apparatus for purifying sodium.

The present invention will be now explained, referring to FIG. 1.

It is known that metal oxides generally have a property as a semi-conductor or electrolyte at a high temperature. When a sodium 2 to be purified and a reducing agent 3 are placed in a container through a partition wall of solid electrolyte 1, and a negative electric potential and a positive electric potential are applied to the sodium to be purified and the reducing agent, respectively, the oxygen in the sodium is migrated to a surface of the solid electrolyte and passed through the solid electrolyte in a form of oxygen ion and then oxidizes the reducing agent. When sodium is used as the reducing agent, the sodium oxide in the sodium in excess of a saturated solubility will deposit as precipitates 4. The oxygen in the liquid sodium to be purified is transferred and removed towards the reducing agent by this phenomenon.

Necessary electric potential E for oxygen transfer is given by the following formula:

$$E = -\frac{RT}{2F} \ln \frac{C_2}{C_1}$$

where R is the gas constant, F the Farady constant, T a temperature, and $C_1$ and $C_2$ oxygen concentrations of the reducing agent and the sodium to be purified, respectively.

When sodium is used as the reducing agent at a sodium temperature of 800°K, and $C_1$ (saturated concentration at 800°K) $\approx$ 800 ppm and $C_2 = 10$ ppm. E will be 0.15 volts, since other constants are given as follows:

$$R = 8.31 \text{ (V.C. g-mole}^{-1}\ {}^{\circ}\text{K}^{-1})$$

$$F = 96500 \text{ (C.g. equivalents}^{-1})$$

It is seen from the foregoing that the oxygen transfer is possible when an electric potential of 0.15 volts or higher is applied to the apparatus. Actually, it is however necessary to apply a little higher electric potential than 0.15 volts to the apparatus, in view of the resistance of the solid electrolyte.

Now, the present invention will be explained in detail.

Figure 3:
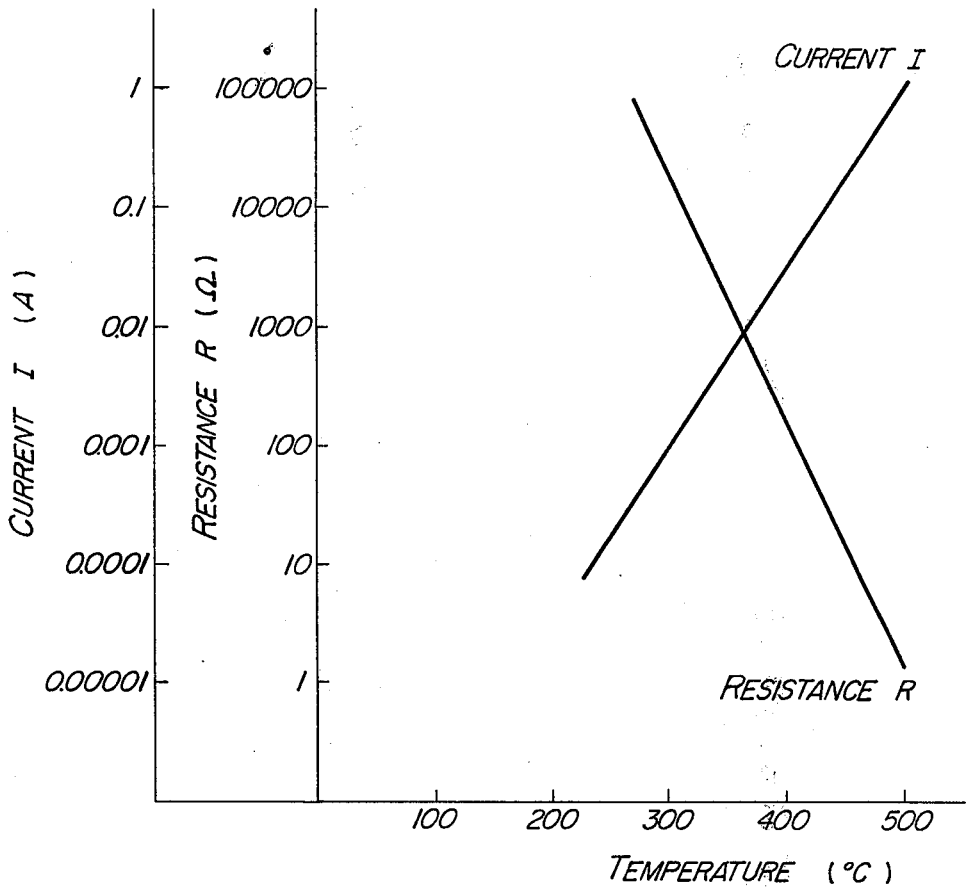
FIG. 3 is a diagram showing relations between temperatures of liquid sodium and current or resistance when the sodium purification is carried out using a solid electrolyte (zirconia.calcia).

A cylindrical solid electrolyte, zirconia.calcia $(ZrO_2)_{0.87}(CaO)_{0.13}$ having a height of 200 mm below a liquid sodium level, an outer diameter of 30 mm and a wall thickness of 2.5 mm was placed in a sodium to be purified, and sodium as a reducing agent was placed in the solid electrolyte. When the liquid sodium was kept at a temperature of 500°C, the electric resistance of the solid electrolyte was 23Ω, as seen from FIG. 3. It was found that a current of 1 A was passed through it at 2.5 volts and 0.3 g/hr of oxygen could be treated. Therefore, when 1 kg of a liquid sodium had an oxygen concentration of 1000 ppm, that is, when 1 g of oxygen was contained in the liquid sodium, purification was carried out for about 3 hours with a power consumption of 7.5 Watt.hour.

Figure 2:
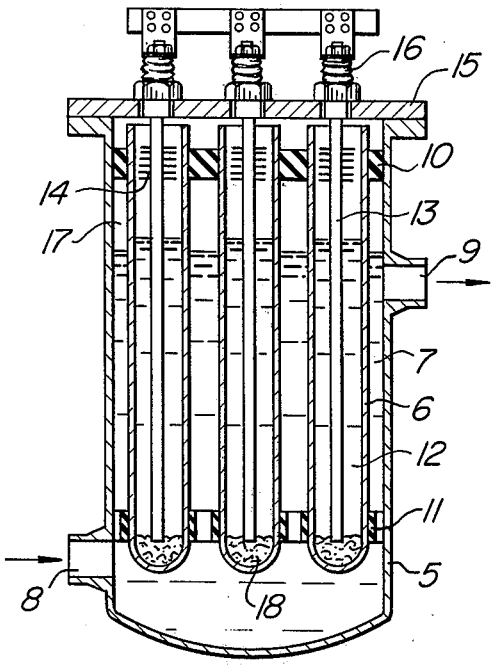
FIG. 2 is a schematic view of another embodiment of the present apparatus for purifying sodium.

Now, the present invention will be explained, referring to FIG. 2.

In a container 5, cylinders 6 consisting of a solid electrolyte such as zirconia.calcia, zirconia.yttria or thoria.yttria are placed. A liquid sodium 7 to be purified is led to the container from an inlet nozzle 8 and passes around the cylinders 6 and flows out of an outlet nozzle 9. The cylinders 6 are fixed by an upper holder 10 and a lower holder 11. The holders 10 and 11 consist of ceramics, and both container 5 and cylinders 6 are electrically isolated. A reducing agent 12, for example, a liquid sodium, is placed in the cylinders and electrodes 13 are each inserted into the cylinders at a center. Baffles 14 are provided at the upper parts of electrodes 13 to shield a heat and prevent rising of sodium vapors. The electrodes are connected to electrode terminals at the outside of the container through a cover of the container and electrical insulator parts 16. A space 17 for inert gas is provided at the upper part of the container, and the sodium 7 to be purified and the sodium 12 to be reduced are electrically connected with each other through the cylinders 6 of solid electrolyte. When a positive electric potential and a negative electric potential are applied to the electrodes 13 and the container 5, oxygen in the sodium 7 is migrated to the cylinders 6 of solid electrolyte and transferred through the solid electrolyte in a form of oxygen ion, and oxidizes the sodium 12 in the cylinders 6. Sodium oxide formed in the sodium 12 in the cylinders then reaches a saturated solubility, deposits only in excess of the saturated solubility and is accumulated at the bottom of the cylinders to form a layer 18.

Any solid electrolyte can be used, so long as the electrolyte can well coexist with the sodium and has a higher electroconductivity and an ionic conductivity ration almost equal to unity, irrespectively of the foregoing example. The present invention is applicable to any liquid zone of sodium, but it is preferable in view of such facts that the resistance of a solid electrolyte considerably varies with temperature and a heat loss as seen in the cold trap or hot trap is to be prevented, to use a relatively constant temperature in a range of 200° to 550°C with a temperature difference of ±50°C.

The following effects can be obtained according to the present invention.

1. A flow loss is small in the apparatus for purification and there is no change in pressure loss by clogging as seen in the cold trap, while the present apparatus is used.

2. Purification characteristics are almost constant while the present apparatus is used.

3. A dimension of the apparatus is reduced to one-half of the dimension of cold trap or hot trap, and the present apparatus can be thus made compact.

4. Heat loss is small in the apparatus, and purification can be carried out with relatively small power.

What is claimed is:

1. An apparatus for purifying liquid sodium comprising an air tight container for encasing an oxygen containing liquid sodium to be purified, a solid electrolyte member for encasing a liquid reducing agent and disposed in said container so that at least a portion of said electrolyte member will be immersed in the oxygen containing liquid sodium to be purified and encased by said container, and anode arranged for contacting the liquid reducing agent, an external electrical means for applying a positive potential to said anodes and a negative potential to the sodium to be purified, whereby the oxygen in the sodium to be purified is transferred through said electrolyte and removed by the liquid reducing agent.

2. An apparatus for purifying liquid sodium which comprises a container for encasing an oxygen containing liquid sodium to be purified, said container having inlet means at a lower part thereof and outlet means at an upper part thereof for liquid sodium, a plurality of cylinders of a solid electrolyte for encasing a liquid reducing agent and disposed in said container so that at least a portion of said electrolyte cylinders will be immersed in the oxygen containing liquid sodium to be purified and encased by said container, each cylinder containing an electrode arranged therein for contacting the liquid reducing agent, a cover for the container for tightly sealing an inert gas in the container, and an external electrical means for applying a positive potential to each of said anodes and a negative potential to the sodium to be purified, whereby the oxygen in the sodium to be purified is transferred through said electrolyte and removed by the liquid reducing agent.

3. An apparatus according to claim 2, wherein said oxygen after being transferred through said cylinders reacts with said liquid reducing agent to produce a solid precipitate and said cylinders include means for collecting precipitate.

4. An apparatus according to claim 2, wherein means are provided to keep said liquid sodium to be purified and said liquid reducing agent at a constant temperature in a range of from about 200° to about 550°C. equally or with a temperature difference of ±50°C.

5. An apparatus according to claim 2, wherein the electrode encased in the cylinder is provided with baffles for preventing rising of vapors of the reducing agent and for reducing heat loss.

6. An apparatus according to claim 1, wherein means are provided to keep said liquid sodium to be purified and the liquid reducing agent at a constant temperature in a range of from about 200° to about 550°C. equally or with a temperature difference of plus or minus 50°C.

7. An apparatus according to claim 1, wherein said electrolyte member is a cylindrical member containing the reducing agent, and wherein said reducing agent is liquid sodium.

8. An apparatus according to claim 1, wherein said oxygen after being transferred through said electrolyte reacts with said liquid reducing agent to produce a solid precipitate and said electrolyte member includes means for collecting precipitate.

* * * * *